United States Patent [19]

Dubiel

[11] Patent Number: 4,513,827

[45] Date of Patent: Apr. 30, 1985

[54] ROTARY TOOL

[75] Inventor: Oswald Dubiel, Neunkirchen-Seelscheid, Fed. Rep. of Germany

[73] Assignee: Paul-Heinz Wagner, Much-Birrenbachshohe, Fed. Rep. of Germany

[21] Appl. No.: 484,436

[22] Filed: Apr. 13, 1983

[30] Foreign Application Priority Data

Apr. 21, 1982 [DE] Fed. Rep. of Germany ..... 3214842

[51] Int. Cl.[3] ..... B25B 23/145

[52] U.S. Cl. ..... 173/12; 173/163; 74/674; 81/467

[58] Field of Search ..... 173/12, 163; 74/674, 74/682, 705, 801; 81/467, 473

[56] References Cited

U.S. PATENT DOCUMENTS

| | | | |
|---|---|---|---|
| 2,834,442 | 5/1958 | Sturrock | 173/12 X |
| 2,951,389 | 9/1960 | Wille | 81/473 X |
| 3,331,452 | 7/1967 | Wanner | 173/12 |
| 3,398,611 | 8/1968 | Hahren | 173/12 X |
| 3,722,300 | 3/1973 | Crooks | 74/674 X |
| 4,095,488 | 6/1978 | Nilsson | 74/801 |
| 4,108,252 | 8/1978 | Stroezel | 173/12 X |
| 4,304,152 | 12/1981 | Michling | 74/682 X |
| 4,328,871 | 5/1982 | Gluskin | 173/12 X |

*Primary Examiner*—E. R. Kazenske
*Assistant Examiner*—W. Fridie
*Attorney, Agent, or Firm*—Diller, Ramik & Wight

[57] ABSTRACT

The rotary tool contains a gear portion (16) whose input shaft (26) is driven by a hydraulic motor. The input shaft (26) is coupled with the output shaft (31) via an overload clutch (35,36,42) to ensure that with a low load, the transmission ratio is 1:1. With a higher load, the overload clutch automatically disengages so that the drive will be effected from the input shaft (26) via a double-stage sun-and-planet gear to the output shaft (31) which then is turning at a lower speed. Between the first stage (I GS) and the second stage (II GS) of the reduction gear, there is an overrunning clutch (52) which only couples with each other the two gear stages if the output shaft (31) turns more slowly than the input shaft (26).

25 Claims, 6 Drawing Figures

ROTARY TOOL

The invention relates to a rotary tool comprising a motor driving the input shaft of a reduction gear and an output shaft drivable via the reduction gear.

Such rotary tools have been used, for instance, as power wrenches to tighten or unscrew bolts or nuts. However, they also lend themselves to other purposes where it is necessary to turn an element with motor drive power against a resistance, e.g. for turning pipes. There have been known rotary tools driven hydraulically or pneumatically for which a button die is applied to the output shaft. Such rotary tools can be changed over to different rotating speeds so that a screw to be tightened is driven first at a higher speed as long as no higher resistance to rotation is offered by it. For finally tightening the screw against a higher resistance to rotation, the drive motor or the reduction gear connected downstream thereof, can be changed over to cause the output shaft to turn at a lower speed at a higher torque. To this effect, the speed is to be changed over manually.

It is the object of the invention to provide a rotary tool as described above in which the speed is automatically changed depending on the load so that with a low torque, rotation is effected at a high speed while, with a high torque or resistance to rotation, rotation is effected at a lower speed.

To solve the problem underlying the invention, it is provided that the input shaft is coupled with the output shaft via an overload coupling and that in the driving path from the input shaft via the reduction gear to the output shaft, there is provided between a first part driven by the input shaft and a second part drivable via the overload clutch by the output shaft an overrunning clutch which only couples the first and the second part with each other if the first part is turning more quickly than the second part.

According to the invention, a direct coupling between the input shaft and the output shaft is realised at a low load so that the output shaft is driven at a ratio of 1:1 to the motor shaft. The motor shaft rotating relatively quickly, the output shaft is running quickly at a relatively low torque. With the increase of the load acting on the output shaft, the overload clutch disengages, thus interrupting the direct drive force from the input shaft to the output shaft. Hence, the output shaft would stop, i.e. it would not rotate at all. In any case, the portion of the overrunning clutch connected to the output shaft will rotate more slowly than the portion of said overrunning clutch connected to the input shaft so that said two portions of the overrunning clutch are coupled non-rotatingly with each other in the stated condition. As a result, the drive force is now transmitted from the input shaft via the reduction gear and the overrunning clutch to the output shaft, while the direct drive from the input shaft to the output shaft is interrupted. As a consequence, the output shaft is driven at a speed ratio to the input shaft as determined by the reduction gear. In other words, with a high load, the output shaft is rotating at a correspondingly low speed and high torque. The change-over is performed automatically with a load predetermined by the disengaging point of the overrunning clutch.

The principle underlying the invention resides in the provision of two parallel transmissions, of which one consists in the direct coupling between input shaft and output shaft, while the other includes the reduction gear. In the first transmission line, an overload clutch is comprised, e.g. a slipping clutch, which, upon exceeding of a specific load moment, disconnects the direct coupling between the input shaft and the output shaft. In the other transmission path including the reduction gear, there is provided the overrunning clutch becoming ineffective if the output shaft is running as quickly or more quickly than the input shaft. On the other hand, if the output shaft is not fully carried along via the overload clutch, the overrunning clutch carries along the second clutch portion thus performing the drive from the input shaft to the output shaft via the overrunning clutch and the reduction gear.

Due to the parallel arrangement of two clutch lines of which one contains an overload clutch and the other an overrunning clutch, it is not possible that both transmissions are operative at the same time, whereby the drive would be blocked. The load moment at which the changeover takes place, is exlusively dictated by the moment or by the load at which the overload clutch is disengaged or the output shaft is not taken along any longer at a speed ratio of 1:1 with the input shaft.

If the rotary tool is provided only for the rotation in one sense, the design of the overrunning clutch does not offer any difficulties. It can be constructed as a "free-running" clutch similar to that of a bike, or like a ratchet. However, the difficulties will be greater if the sense of rotation of the drive motor—and the sense of rotation of the output shaft accordingly—shall be reversible, in other words, if the rotary tool shall operate optionally in both directions of rotation. To ensure also in this case the automatic load-dependent change over, it is provided, according to a preferred embodiment of the invention that the first part of the overrunning clutch has a multiple cornered profile, the second part having a round profile coaxial thereto, and that between the two profiles, rolls or balls are arranged, The resultant free running system effective in both senses of rotation, always acts as an engaging means if the first part turns more quickly than the second part regardless of the respective sense of rotation. If both parts turn at the same speed, no coupling engagement at the overrunning clutch is taking place. The same applies to the case where the round profile of the second part is turning more quickly than the multiple cornered profile of the first part. An interruption of the drive force via the overruning clutch is always effective if the output shaft is directly driven by the input shaft via the overload clutch.

One of the two profiles of the overruning clutch is a hollow or inner profile, while the other profile part is an external profile. In other words, either the round profile consists of the inner wall of a tube, while the multiple cornered profile is, for instance, an external hexagon, or the multiple cornered profile is for inst. an internal hexagon, while the round profile is formed by the cylindrical outer wall of a round bar.

The overload clutch consists of a slipping clutch if its design is very simple. A slipping clutch, however, involving torque losses in case of slipping, a preferred embodiment of the invention, in view of avoiding such frictional losses, provides that the overload clutch contains at least one clutch portion non-rotatingly connected to the input shaft and being pressed by spring action against the output shaft, and that a cylinder chamber is provided which, in compressed condition of the spring means, is connected to a hydraulic line to thus maintain the spring means compressed by the hydraulic pressure. As soon as the overload clutch disengages, the cylinder chanber is connected to the hydraulic line whose pressure ensures that the cylinder chamber is kept open to take its maximum volume accordingly. As a result, the spring means are compressed hydraulically to relieve the overload clutch. No frictional losses will occur any longer at the overload clutch if pressure is applied to the cylinder chamber.

Preferably, the hydraulic line is connected to the pressure line of the drive motor designed as a hydraulic motor; therefore, with a pressure drop due to a low load of the hydraulic motor, the spring will urge the coupling element to come into engagement with the output shaft. Accordingly the hydraulic pressure for relievering the overload clutch is derived from the precursory pressure of the hydraulic motor, the overload clutch engaging again as soon as the precursory pressure is reduced upon falling below a specific load moment.

The reduction gear preferably is a multistage planet gear, the overrunning clutch being provided between the planet wheel cage of one gear stage and the sun wheel of the subsequent gear stage. In case of engagement of the overload clutch, the subsequent gear stage is also rotating but idling, its sun wheel turning more quickly than the planet wheel cage of the first gear stage so that the overrunning clutch cannot establish any frictional connection.

It is suitable to connect the planet wheel cage of the subsequent gear stage non-rotatingly to the output shaft. This is advantageous in that the speeds of the two parts of the overrunning clutch are relatively low so as to ensure a regular operation of the overrunning clutch. Basically, the overrunning clutch can be also disposed at the input side of the reduction gear, but speeds there are considerably higher.

One embodiment of the invention will be explained hereinafter more fully with reference to the drawings.

Figure 1:
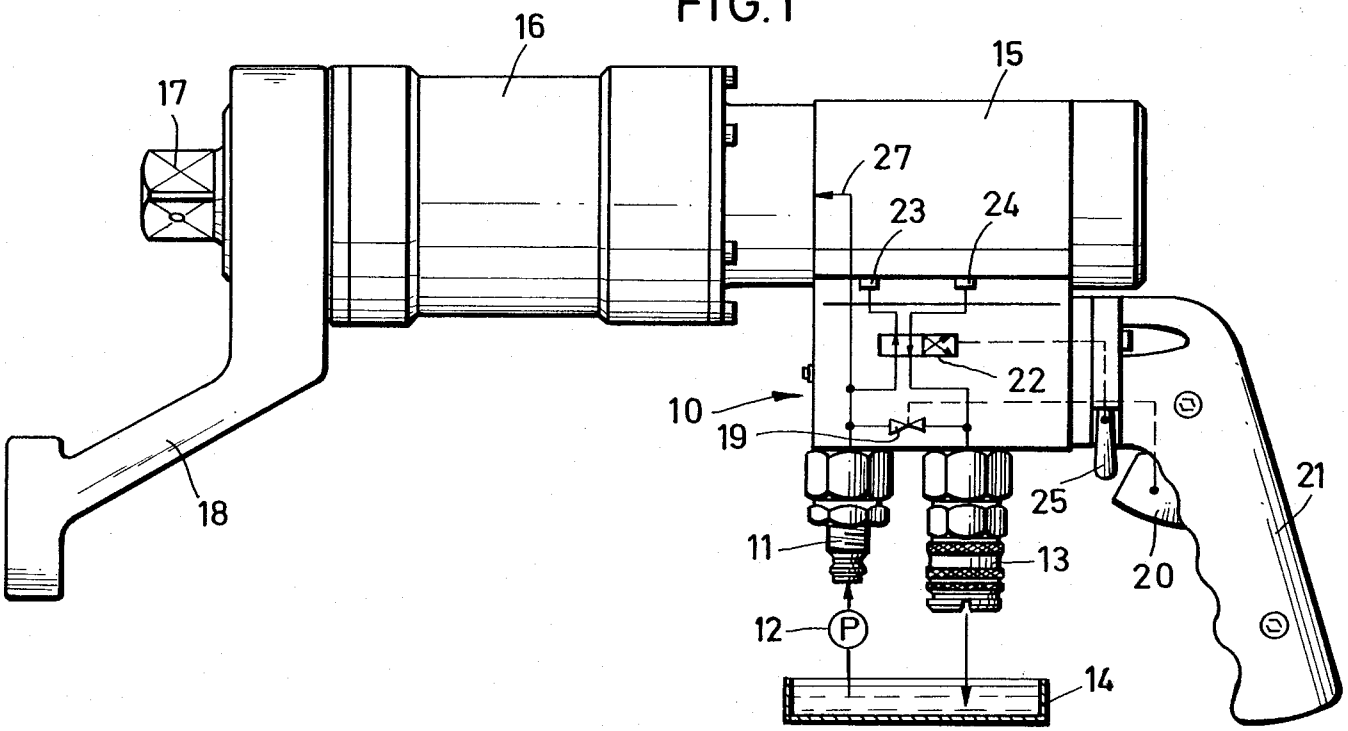
FIG. 1 is a side view of the rotary tool, the switching and control portion showing the symbols of the hydraulic components contained therein.

The illustrated rotary tool is used as a hydraulically driven power wrench to rotate screws. It comprises a switching and control portion 10 being joined via a pressure connection 11 to a pump 12 and via a tank connection 13 to a return line leading to a tank 14. The switching and control portion 10 supplies hydraulic fluid to a hydraulic motor 15. The shaft of the hydraulic motor 15 drives the input shaft of the gear portion 16. An output shaft 31 of the gear portion 16 includes a square 17 to which a button die can be applied for the setting of a screw. The housing of the gear portion 16 is connected non-rotatingly to a retainer 18 which projects laterally and obliquely in forward direction to be placed against a solid abutment so as to prevent the housing as well as the motor 15 from being rotated due to the reaction force developed during screwing.

As shown in FIG. 1, the pressure connection 11 is joined to the tank connection 13 via a throttle valve 19. The opening position of the throttle valve 19 is manually adjusted via a lever 20 operable by the index finger and situated in a pistol-shaped handle 21. If the throttle valve 19 is completely open, the pressure connection 11 is in full communication with the tank connection 13. This is applicable if the lever 20 being released, is pressed by a (non-illustrated) spring into the rest position shown in FIG. 1. On the other hand, if the lever 20 is pressed into the handle 21, the throttle valve 19 is closed proportionally.

In addition, the pressure connection 11 and the tank connection 13 are in communication with a pilot valve 22 connecting said connections to the consumer's terminals 23 or 24 of the hydraulic motor 15. The pilot valve 22 can be changed over to permit a reversal of the sense of rotation of the shaft of the hydraulic motor 15. The pilot valve 22 is changed over by means of a lever 25 pivoted at the handle 21. If the lever 25 is swiveled from the drafted position, the consumer's terminal 24 rather than 23 is connnected to the pressure connection 11, while in place of the consumer's terminal 24, terminal 23 is connected to the tank connection 13. By actuating levers 20 and 25, it is possible to change the sense of rotation and the driving moment of the hydraulic motor 15.

The (non-illustrated) shaft of the hydraulic motor 15 is connected non-rotatingly to the input shaft 26 of the gear part 16. A substantial portion of the length of the input shaft 26 is hollow, its longitudinal bore 27 communicating with the pressure connection 11.

The front end of the input shaft 26 is provided with a square 28 coacting with a suitable inner square of a plate 29 projecting radially from the input shaft 26 thus maintaining the plate 29 non-rotatingly but displaceable longitudinally on the input shaft 26. The plate 29 is axially supported with a cylindrical bushing 30 in an axial recess of the output shaft 31. The output shaft 31 provided at its front end with the square 17 is supported by roller bearings 33 in a hollow cylindrical attachment 32 of the housing of the gear part 16. The attachment 32 comprises an external toothing 32' meshing with an internal toothing of the retainer 18 to permit to mount the retainer 18 (FIG. 1) nonrotatingly but axially displaceable at the gear part 16. Inside the housing, the output shaft 31 has a radially projecting flange 34 the rear end of which is provided with pocket bores 35, situated on a circle and at the openings of which the balls 36 are supported which are held in passage bores of the plate 29, but which, in axial direction, are projecting from the front and rear end of the plate 29. The latter thus serves as a cage to guide the balls which are engaged in the pocket bores 35.

The balls 36 are pressed towards the pocket bores 35 by a pressure ring 37 arranged coaxially to the input shaft 26 and against which, via radially aligned needles 38, a pressure cylinder 39 is effective which, by itself, is pressed axially in forward direction by a pressure ring 41. Against the front side of the pressure ring 41, a spring 42 enclosing coaxially the input shaft 26, is pressing which is axially supported by the planet wheel cage or gear cage 43 of the second gear stage II GS. Said planet gear cage 43 is firmly connected by screws 44 to the flange 34 of the output shaft 31.

Figure 2:
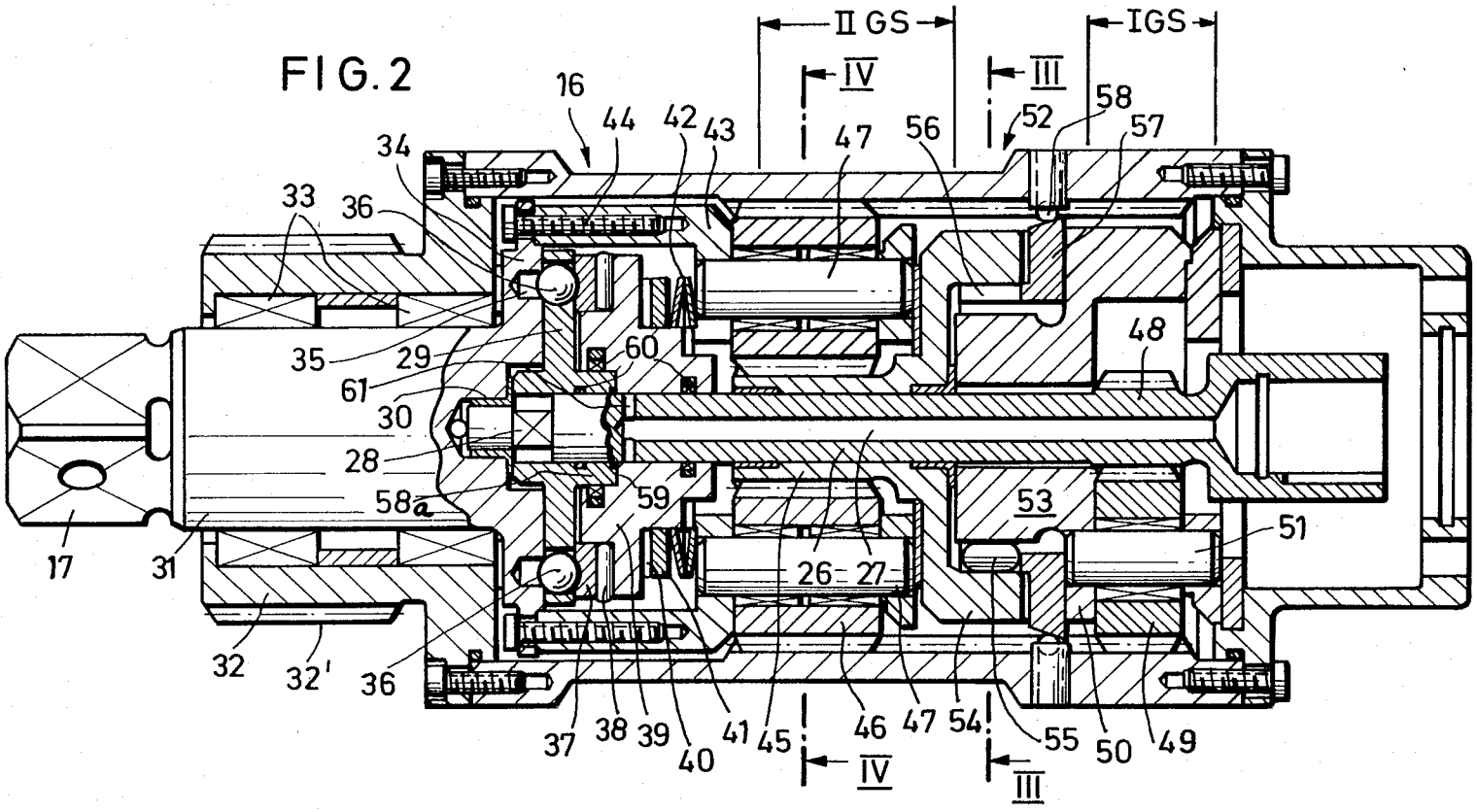
FIG. 2 is a longitudinal section of the gear portion of the rotary tool according to FIG. 1.
Figure 4:
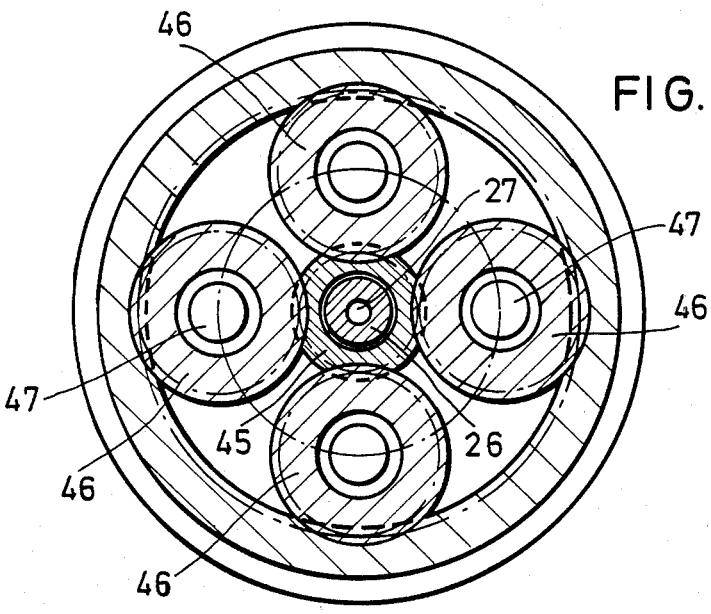
FIG. 4 is a cross section of the second stage of the planet gear along line IV—IV of FIG. 2.

The second gear stage II GS has a sun wheel or gear 45 (FIGS. 2 and 4) rortably supported by the input shaft 26, as well as a plurality of planet wheels 46 meshing with the teeth of the sun wheel 45 (FIGS. 2 and 4). In a manner known per se, the planet wheels 46 are supported by axles 47 forming part of the planet wheel cage 43.

The first gear stage I GS is of a similar design comprising a sun wheel or gear 48 solidly joined to the input shaft 26 and about which the planet wheels or gears 49 are running. Said planet wheels are supported by the axles 51 of the planet wheel cage or gear cage 50.

Figure 3:
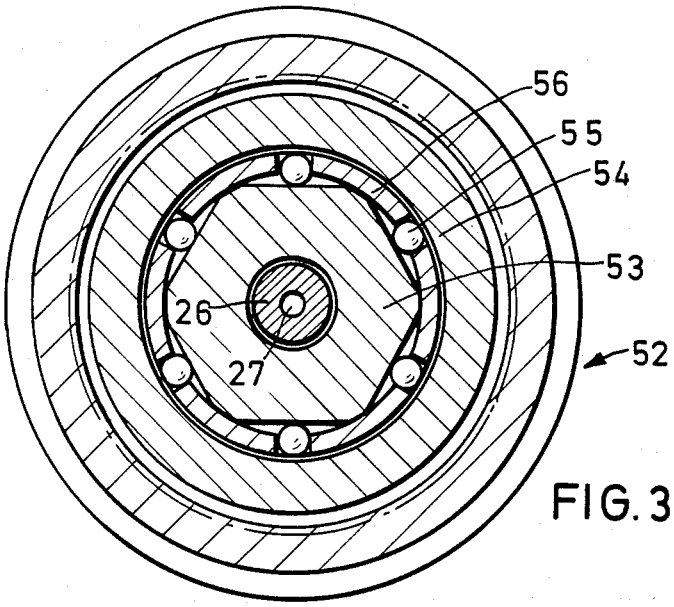
FIG. 3 is a cross section of the overrunning clutch along line III—III of FIG. 2.

The overrunning clutch 52, situated between the first gear stage I GS and the second gear stage II GS and of which a cross section is shown in FIG. 3, has a first element 53 firmly joined to the planet wheel cage 50 of the first gear stage, the outer contour of said element being of a hexagonal shape. The first element 53 is radially spaced of the second element 54. The second element 54 firmly connected to the sun wheel 45 of the second gear stage II GS has a cylindrical inner surface. Between the latter and the outer surface of the first element 53 there are provided rolls 55 which are aligned coaxially to the input shaft 26. Said rolls 55 are maintained in an annular cage 56 comprising a corresponding recess for each roll 55. The cage 56 has a radially projecting flange 57 with an external inclination against which the balls 58 under spring action held at the casing, are pressing.

As evident from FIG. 3, the second element 54 of the overrunning clutch 52 can freely rotate relative to the first element 53, whereby the rolls 55 are adjusted to a corresponding point of maximum radial freedom, i.e. in the center of a hexagonal flank of element 53, as is illustrated in FIG. 3. If the first element 53 is rotated relative to the second element 54, rolls 55 are taken along by leaving their central position relative to the hexagonal flanks to be clamped between element 53 and the second element 54. Due to said clamping action, the second element 54 with the first element 53 are entrained or clamped together. The overrunning clutch 52 thus causes the rolls 55 to always be urged into the clamping position (position of entrainment) if the first element 53 turns more quickly in one of the two senses of rotation than the second element 54 does. If both elements 53 and 54 are rotating at the same speed or if the second element 54 is rotating more quickly than the first, the rolls 55 maintain the center position as illustrated in FIG. 3 so that no flux of force is effective via the overrunning clutch 52.

Figure 5:
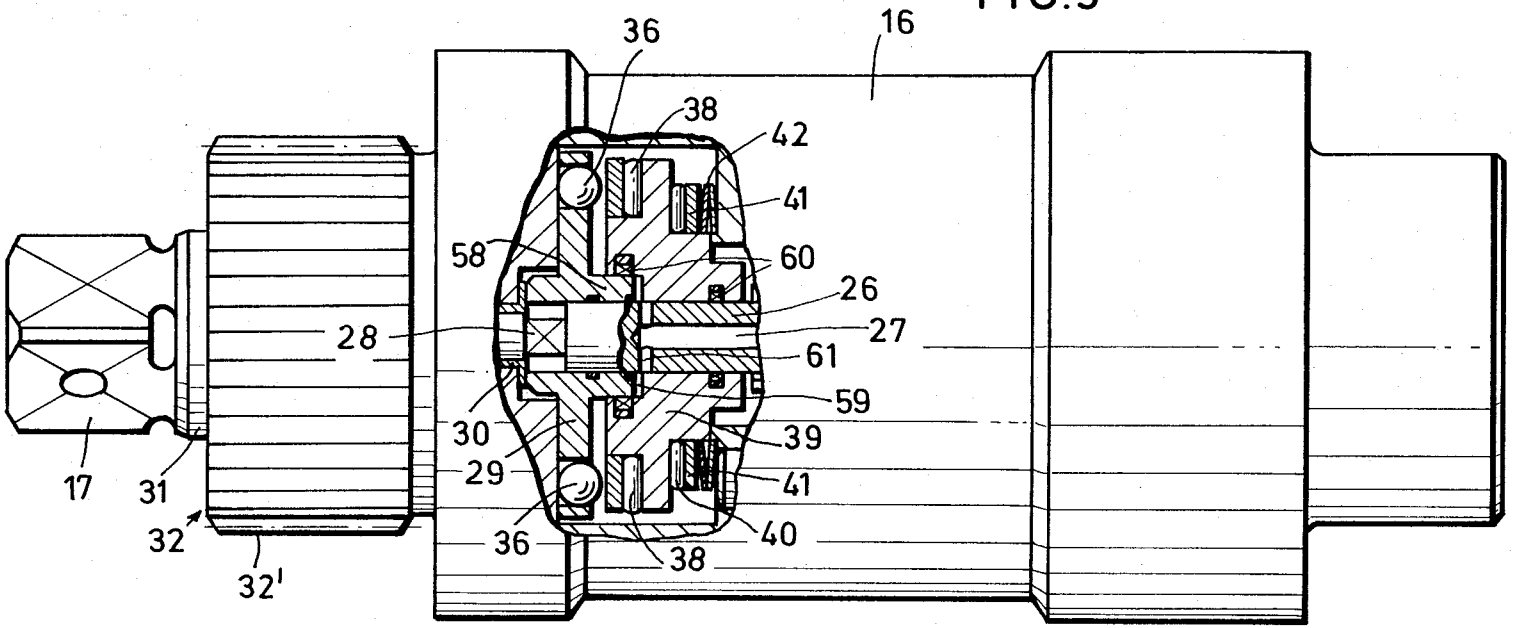
FIG. 5 shows the cylinder chamber in open condition.

Between the hub 58*a* of the plate 29 tightly enclosing the end of the input shaft 26 and the cylinder 29, a cylinder chamber 59 is sealed to all sides by seals 60, as is best shown in FIG. 5. If cylinder 39 is urged back by the balls 36 against the action of spring 42, the cylinder chamber 59 is flared to the rear thus causing radial outlets 61 of the bore 27 to get into the region of the cylinder chamber 59. By this means, pressure oil may flow into the cylinder chamber 59 to keep it open, whereby spring 42 is held hydraulically in tensioned condition so that the balls 36 are relieved from the axial pressure.

The operation of the rotary tool will be disclosed now hereunder:

First off, the components of the gear portion 16 are situated as illustrated in FIG. 2, in which the balls 36 are pressed by the action of spring 42 against the pocket bores 35 of the output shaft 31. Upon a turning of the input shaft 26, the output shaft 31 is taken along by it via the balls 36, which, together with the pocket bores 35 and the spring 42 form the overload clutch 35,36,42. The output shaft 31, being driven relative to the input shaft 26 at a ratio of 1:1 is rotating at the relatively high speed of the input shaft. The planet wheel cage 43 being firmly joined to the output shaft 31, the planet wheels 46 of the second gear stage II GS are rotating whereby the sun wheel 45 supported by the input shaft 26, is also turned. At the same time, the second part of the overrunning clutch 52 firmly connected to the sun wheel 45, is also rotating. The speed of the second part 54 is higher than that of the first part 53 driven by the first gear stage I GS, and, as a result, the parts 53, 54 of the overrunning clutch 52 are not entrained mutually.

If a screw is driven this way in idle motion by a quick rotation, and if the load moment is increased accordingly, the balls 36 are disengaged from the pocket bores 35, and spring 42 will be compressed. The direct coupling between the input shaft 26 and the output shaft 31 is now disconnected. According to FIG. 5, the cylinder chamber 59 is flared into the region of the radial outlets 61, and, by the hydraulic pressure, it is maintained in the flared condition. Plate 29 goes on rotating together with the input shaft 26, and the balls 36 are taken along by it, but relative to the output shaft 31, said balls 31 can freely rotate. Since they are not exposed any longer to the pressure of spring 42, they are relieved hydraulically.

It can be submitted that the output shaft 31 comes first to a standstill shortly after the balls 36 have been disengaged from the pocket bores 35, because the direct coupling with the input shaft 26 is given up. In other words, the second gear stage II GS and the second part 54 of the overrunning clutch 52 are arrested at the same time. The first part 53 of the overrunning clutch having a higher speed than the second part 54, the rolls 55 are clamped between the first part 53 and the second part 54, thus bringing about a coupling of the second gear stage II GS to the first gear stage I GS via the overrunning clutch 52. Now, the output shaft 31 is driven by the input shaft 26 via the two gear stages I GS and II GS at a substantially lower speed and at a correspondingly higher torque.

The screw is tightened more slowly and at a higher force accordingly.

The pressure in the cylinder chamber 59 is maintained until the throttle valve 19 (FIG. 1) is opened to an extent so as to cause a corresponding pressure drop in the line 27.

This will occur if the lever 20 is released partly or completely. If so, the throttle valve 19 is opened and the hydraulic fluid supplied from the pump 12 through the pressure connection 11 is fed back unpressurized into tank 14. Now the hydraulic pressure is not high enough to keep the pressure chamber 59 open so that it is closed under the action of spring 42, while the balls 36 again engage the pocket bores 35. The output shaft 31 is recoupled directly to the input shaft 26.

Figure 6:
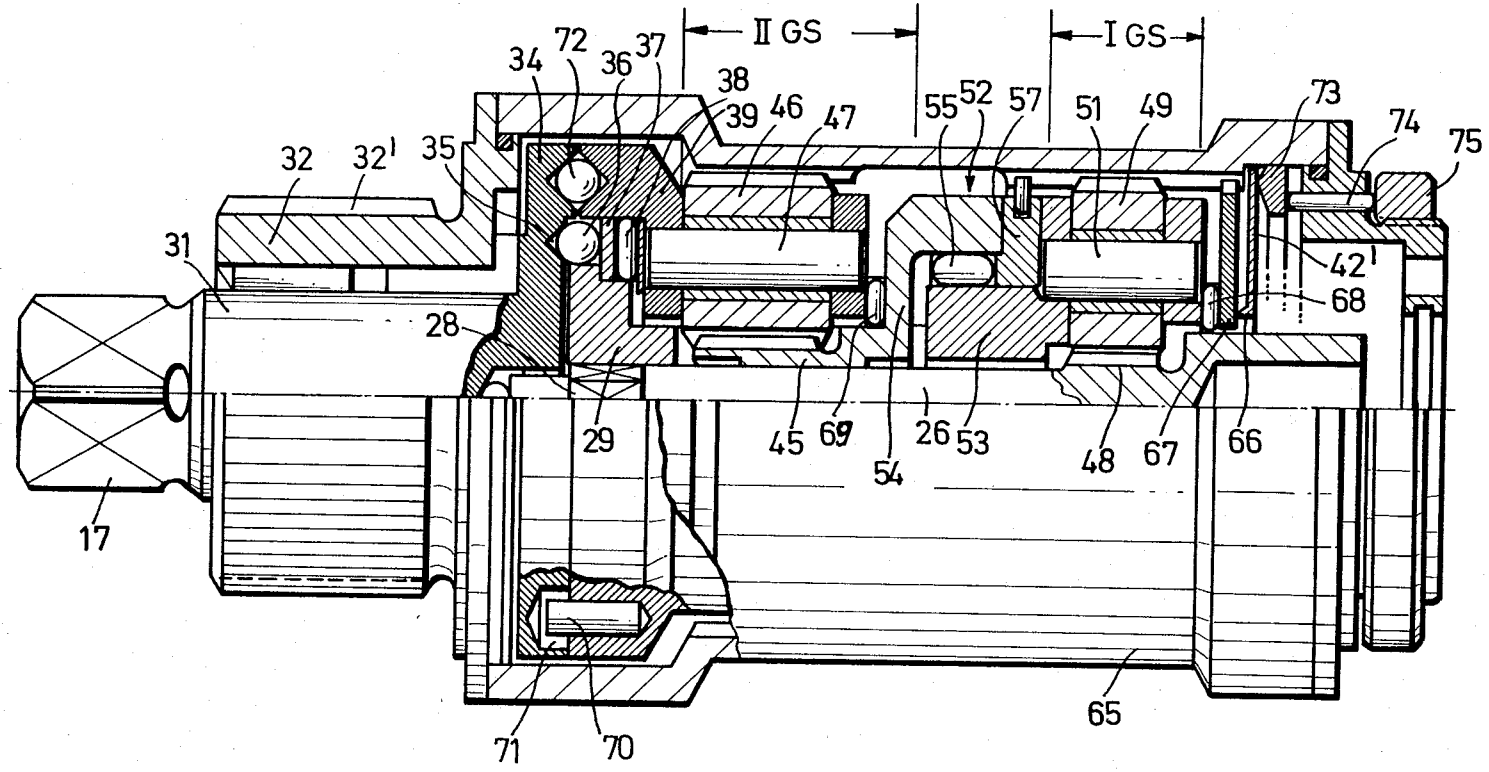
FIG. 6 shows a second embodiment of the invention.

The embodiment of FIG. 6 corresponds to a far extent to that of FIGS. 1 to 5 thus permitting to restrict the following description to the explanation of the existing differences. In the embodiment of FIG. 6 the spring 42' urging the pressure member 39 towards flange 34 of the output shaft 31 is situated inside the housing 65 near the rear housing end. Spring 42' is a radial leaf-shaped plate having at its inner end a border 66 pointing forwardly and pressing against a rigid pressure plate 67 supported via an axial thrust bearing 68 at the first part 53 of the overruning clutch 52, whose second part 54 is supported at the pressure member 39 forming the cage of the second gear stage II GS via another axial thrust bearing 69. Thus, the axial force of spring 42 is transmitted via the first gear stage I GS, the overrunning clutch 52 and the second gear stage II GS as well as via the needles 38 and the pressure ring 37 to the balls 36 which are pressed with a predetermined force into the recesses 35 of the flange 34. With a low load moment, the plate 29 non-rotatingly connected to the input shaft 26, is coupled via the balls 36 with the flange 34 of the output shaft 31. If the load moment exceeds the set limit value, the balls 36 are leaving the recesses 35, while the spring 42' is pressed back (to the right). At the same time, the first gear stage I GS, the overrunning clutch 52 and the second gear stage II GS within the housing 65 are slightly displaced. The first part 53 of the overrunning clutch 52 now rotating more quickly than the second part 54, the rolls 55 are clamped as described before thus ensuring the power transmission from the input shaft 26 via the first gear stage I GS, the overrunning clutch 52, the second gear stage II GS and the pressure member 39 to the flange 34 of the output shaft 31. The pressure member 39 is provided with axially projecting pins 70 which enter the corresponding recesses 71 of flange 34 so that the pressure member 39 is always coupled nonrotatingly with the flange 34. Moreover, between the pressure member 39 and the flange between the respective pins 70 and recesses 71, there are further balls 72 which enter corresponding recesses.

In the embodiment of FIG. 6, no hydraulic pressure chamber is provided for relieving the axial pressure exerted on the balls 36. Therefore, said balls 36 are engaging for a short time each of the recesses 35 of the flange.

A pressure ring 73 situated in the housing 65 presses against the outer edge of spring 42'. Axial pins 74 adjoin the outside of the pressure ring 73 and their outer ends are butting against a threaded ring 75 which is screwed on an external thread of housing 65. By turning the threaded ring 75, it is possible to change the initial stress of spring 42' to adjust the overload moment at which the balls 36 are disengaged.

If necessary, spring 42 or 42' for the overload clutch can be also mounted between the two gear stages I GS and II GS or also in the lower region of the second gear stage.

What is claimed is:

1. A rotary tool comprising an input shaft and an output shaft, overload clutch means between said input and output shafts for selectively drivingly connecting and disconnecting said input and output shafts, said overload clutch means drivingly connecting said input and output shafts upon relatively low load conditions of said output shaft to effect a predetermined drive ratio between said input and output shafts, first and second reduction gear means between said input and output shafts for selectively varying said predetermined drive ratio upon an increase load condition of said output shaft to decrease output shaft speed and increase output shaft torque, said overload clutch means drivingly disconnecting said input and output shafts upon an increase load condition of said output shaft and overrunning clutch means between said first and second reduction gear means for drivingly connecting said first and second reduction gear means upon said overload clutch means drivingly disconnecting said input and output shafts whereby said output shaft is driven through said first and second reduction gear means from said input shaft to thereby decrease output shaft speed and increase output shaft torque, said overrunning clutch means includes first and second overrunning clutch members coupled to the respective first and second reduction gear means, said first overrunning clutch member being in driving relationship to said input shaft through said first reduction gear means, said first and second overrunning clutch members being drivingly connected upon said input shaft speed being greater than said output shaft speed, said first and second overrunning clutch members have surface portions in generally spaced telescopic coaxial relationship with clutch elements disposed therebetween, a first of said surface portions being generally cylindrical, and a second of said surface portions having a plurality of flats whereby the location of said clutch elements relative to said cylinder and flats effects the engagement and disengagement of said first and second overrunning clutch members.

2. A rotary tool comprising an input shaft and an output shaft, overload clutch means between said input and output shafts for selectively drivingly connecting and disconnecting said input and output shafts, said overload clutch means drivingly connecting said input and output shafts upon relatively low load conditions of said output shaft to effect a predetermined drive ratio between said input and output shafts, first and second reduction gear means between said input and output shafts for selectively varying said predetermined drive ratio upon an increase load condition of said output shaft to decrease output shaft speed and increase output shaft torque, said overload clutch means drivingly disconnecting said input and output shafts upon an increase load condition of said output shaft and overrunning clutch means between said first and second reduction gear means for drivingly connecting said first and second reduction gear means upon said overload clutch means drivingly disconnecting said input and output shafts whereby said output shaft is driven through said first and second reduction gear means from said input shaft to thereby decrease output shaft speed and increase output shaft torque, said overrunning clutch means includes first and second overrunning clutch members coupled to the respective first and second reduction gear means, said first overrunning clutch member being in driving relationship to said input shaft through said first reduction gear means, said first and second overrunning clutch members being drivingly connected upon said input shaft speed being greater than said output shaft speed, and means for fluidically disengaging the drive connection of said overload clutch means.

3. A rotary tool comprising an input shaft and an output shaft, overload clutch means between said input and output shafts for selectively drivingly connecting and disconnecting said input and output shafts, said overload clutch means drivingly connecting said input and output shafts upon relatively low load conditions of said output shaft to effect a predetermined drive ratio between said input and output shafts, first and second reduction gear means between said input and output shafts for selectively varying said predetermined drive ratio upon an increase load condition of said output shaft to decrease output shaft speed and increase output shaft torque, said overload clutch means drivingly disconnecting said input and output shafts upon an increase load condition of said output shaft and overrunning clutch means between said first and second reduction gear means for drivingly connecting said first and second reduction gear means upon said overload clutch means drivingly disconnecting said input and output shafts whereby said output shaft is driven through said first and second reduction gear means from said input shaft to thereby decrease output shaft speed and increase output shaft torque, said overrunning clutch means includes first and second overrunning clutch members coupled to the respective first and second reduction gear means, said first overrunning clutch member being in driving relationship to said input shaft through said first reduction gear means, said first and second overrunning clutch members being drivingly connected upon said input shaft speed being greater than said output shaft speed, spring biasing means for engaging the driving connection of said overload clutch means, and means for fluidically disengaging said spring biasing means to disengage the driving connection of said overload clutch means.

4. A rotary tool comprising an input shaft and an output shaft, overload clutch means between said input and output shafts for selectively drivingly connecting and disconnecting said input and output shafts, said overload clutch means drivingly connecting said input and output shafts upon relatively low load conditions of said output shaft to effect a predetermined drive ratio between said input and output shafts, first and second reduction gear means between said input and output shafts for selectively varying said predetermined drive ratio upon an increase load condition of said output shaft to decrease output shaft speed and increase output shaft torque, said overload clutch means drivingly disconnecting said input and output shafts upon an increase load condition of said output shaft and overrunning clutch means between said first and second reduction gear means for drivingly connecting said first and second reduction gear means upon said overload clutch means drivingly disconnecting said input and output shafts whereby said output shaft is driven through said first and second reduction gear means from said input shaft to thereby decrease output shaft speed and increase output shaft torque, said overrunning clutch means includes first and second overrunning clutch members coupled to the respective first and second reduction gear means, said first overrunning clutch member being in driving relationship to said input shaft through said first reduction gear means, said first and second overrunning clutch members being drivingly connected upon said input shaft speed being greater than said output shaft speed, spring biasing means for engaging the driving connection of said overload clutch means, means for fluidically disengaging said spring biasing means to disengage the driving connection of said overload clutch means, said overload clutch means include first and second clutch plates carried respectively by said output shaft and said input shaft, a plurality of clutch elements between said plates, said spring biasing means being effective for urging said clutch plates into cooperative driving engagement through said clutch elements, and said fluidic disengaging means being effective for urging said clutch plates apart against the force of said spring biasing means.

5. A rotary tool comprising an input shaft and an output shaft, overload clutch means between said input and output shafts for selectively drivingly connecting and disconnecting said input and output shafts, said overload clutch means drivingly connecting said input and output shafts upon relatively low load conditions of said output shaft to effect a predetermined drive ratio between said input and output shafts, first and second reduction gear means between said input and output shafts for selectively varying said predetermined drive ratio upon an increase load condition of said output shaft to decrease output shaft speed and increase output shaft torque, said overload clutch means drivingly disconnecting said input and output shafts upon an increase load condition of said output shaft and overrunning clutch means between said first and second reduction gear means for drivingly connecting said first and second reduction gear means upon said overload clutch means drivingly disconnecting said input and output shafts whereby said output shaft is driven through said first and second reduction gear means from said input shaft to thereby decrease output shaft speed and increase output shaft torque, said overrunning clutch means includes first and second overrunning clutch members coupled to the respective first and second reduction gear means, said first overrunning clutch member being in driving relationship to said input shaft through said first reduction gear means, said first and second overrunning clutch members being drivingly connected upon said input shaft speed being greater than said output shaft speed, means for fluidically disengaging the driving connection of said overload clutch, fluidic motor means for driving said input shaft, and means responsive to a pressure drop caused by resistance to the driving of said fluidic motor means for discontinuing the operation of said fluid disengaging means whereby said output shaft is driven by said input shaft through said overload clutch means.

6. A rotary tool comprising an input shaft and an output shaft, overload clutch means between said input and output shafts for selectively drivingly connecting and disconnecting said input and output shafts, said overload clutch means drivingly connecting said input and output shafts upon relatively low load conditions of said output shaft to effect a predetermined drive ratio between said input and output shafts, first and second reduction gear means between said input and output shafts for selectively varying said predetermined drive ratio upon an increase load condition of said output shaft to decrease output shaft speed and increase output shaft torque, said overload clutch means drivingly disconnecting said input and output shafts upon an increase load condition of said output shaft and overrunning clutch means between said first and second reduction gear means for drivingly connecting said first and second reduction gear means upon said overload clutch means drivingly disconnecting said input and output shafts whereby said output shaft is driven through said first and second reduction gear means from said input shaft to thereby decrease output shaft speed and increase output shaft torque, said overrunning clutch means includes first and second overrunning clutch members coupled to the respective first and second reduction gear means, said first overrunning clutch member being in driving relationship to said input shaft through said first reduction gear means, said first and second overrunning clutch members being drivingly connected upon said input shaft speed being greater than said output shaft speed, said first and second reduction gear means are planetary gear sets each including a sun gear and planet gears carried by a cage, and said overrunning clutch means is coupled between the planet cage of one said first and second reduction gear means and the sun gear of the other of said first and second reduction gear means.

7. A rotary tool comprising an input shaft and an output shaft, overload clutch means between said input and output shafts for selectively drivingly connecting and disconnecting said input and output shafts, said overload clutch means drivingly connecting said input and output shafts upon relatively low load conditions of said output shaft to effect a predetermined drive ratio between said input and output shafts, first and second reduction gear means between said input and output shafts for selectively varying said predetermined drive ratio upon an increase load condition of said output shaft to decrease output shaft speed and increase output shaft torque, said overload clutch means drivingly disconnecting said input and output shafts upon an increase load condition of said output shaft and overrunning clutch means between said first and second reduction gear means for drivingly connecting said first and second reduction gear means upon said overload clutch means drivingly disconnecting said input and output shafts whereby said output shaft is driven through said first and second reduction gear means from said input shaft to thereby decrease output shaft speed and increase output shaft torque, said overrunning clutch means includes first and second overrunning clutch members coupled to the respective first and second reduction gear means, said first overrunning clutch member being in driving relationship to said input shaft through said first reduction gear means, said first and second overrunning clutch members being drivingly connected upon said input shaft speed being greater than said output shaft speed, said first and second reduction gear means are planetary gear sets each including a sun gear and planet gears carried by a cage, said overrunning clutch means is coupled between the planet cage of one of said first and second reduction gear means and the sun gear of the other of said first and second reduction gear means, and the planet cage of said other first and second reduction gear means is fixedly carried by said output shaft.

8. The rotary tool as defined in claim 1 wherein said overload clutch means includes first and second clutch plates carried respectively by said output shaft and said input shaft, a plurality of clutch elements between said plates, and means biasingly urging said plates into cooperative driving engagement through said clutch elements.

9. The rotary tool as defined in claim 1 including means for fluidically disengaging the driving connection of said overload clutch means.

10. The rotary tool as defined in claim 1 including spring biasing means for engaging the driving connection of said overload clutch means, and means for fluidically disengaging said spring biasing means to disengage the driving connection of said overload clutch means.

11. The rotary tool as defined in claim 1 including spring biasing means for engaging the driving connection of said overload clutch means, means for fluidically disengaging said spring biasing means to disengage the driving connection of said overload clutch means, said overload clutch means include first and second clutch plates carried respectively by said output shaft and said input shaft, a plurality of clutch elements between said plates, said spring biasing means being effective for urging said clutch plates into cooperative driving engagement through said clutch elements, and said fluidic disengaging means being effective for urging said clutch plates apart against the force of said spring biasing means.

12. The rotary tool as defined in claim 1 including means for fluidically disengaging the driving connection of said overload clutch, fluidic motor means for driving said input shaft, and means responsive to a pressure drop caused by resistance to the driving of said fluidic motor means for discontinuing the operation of said fluidic disengaging means whereby said output shaft is driven by said input shaft through said overload clutch means.

13. The rotary tool as defined in claim 1 wherein said first and second reduction gear means are planetary gear sets each including a sun gear and planet gears carried by a cage, and said overrunning clutch means is coupled between the planet cage of one said first and second reduction gear means and the sun gear of the other of said first and second reduction gear means.

14. A rotary tool comprising an input shaft and an output shaft, overload clutch means between said input and output shafts for selectively drivingly connecting and disconnecting said input and output shafts, said overload clutch means drivingly connecting said input and output shafts upon relatively low load conditions of said output shaft to effect a predetermined drive ratio between said input and output shafts, first and second reduction gear means between said input and output shafts for selectively varying said predetermined drive ratio upon an increase load condition of said output shaft to decrease output shaft speed and increase output shaft torque, said overload clutch means drivingly disconnecting said input and output shafts upon an increase load condition of said output shaft and overrunning clutch means between said first and second reduction gear means for drivingly connecting said first and second reduction gear means upon said overload clutch means drivingly disconnecting said input and output shafts whereby said output shaft is driven through said first and second reduction gear means from said input shaft to thereby decrease output shaft speed and increase output shaft torque, said overrunning clutch means includes first and second overrunning clutch members coupled to the respective first and second reduction gear means, said first overrunning clutch member being in driving relationship to said input shaft through said first reduction gear means, said first and second overrunning clutch members being drivingly connected upon said input shaft speed being greater than said output shaft speed, said overload clutch means includes first and second clutch plates carried respectively by said output shaft and said input shaft, a plurality of clutch elements between said plates, means biasingly urging said plates into cooperative driving engagement through said clutch elements, and means for fluidically disengaging the driving connection of said overload clutch.

15. A rotary tool comprising an input shaft and an output shaft, overload clutch means between said input and output shafts for selectively drivingly connecting and disconnecting said input and output shafts, said overload clutch means drivingly connecting said input and output shafts upon relatively low load conditions of said output shaft to effect a predetermined drive ratio between said input and output shafts, first and second reduction gear means between said input and output shafts for selectively varying said predetermined drive ratio upon an increase load condition of said output shaft to decrease output shaft speed and increase output shaft torque, said overload clutch means drivingly disconnecting said input and output shafts upon an increase load condition of said output shaft and overrunning clutch means between said first and second reduction gear means for drivingly connecting said first and second reduction gear means upon said overload clutch means drivingly disconnecting said input and output shafts whereby said output cshaft is driven through said first and second reduction gear means from said input shaft to thereby decrease output shaft speed and increase output shaft torque, said overrunning clutch means includes first and second overrunning clutch members coupled to the respective first and second reduction gear means, said first overrunning clutch member being in driving relationship to said input shaft through said first reduction gear means, said first and second overrunning clutch members being drivingly connected upon said input shaft speed being greater than said output shaft speed, said overload clutch means includes first and second clutch plates carried respectively by said output shaft and said input shaft, a plurality of clutch elements between said plates, means biasingly urging said plates into cooperative driving engagement through said clutch elements, spring biasing means for engaging the driving connection of said overload clutch means, and means for fluidically disengaging said spring biasing means to disengage the driving connection of said overload clutch means.

16. A rotary tool comprising an input shaft and an output shaft, overload clutch means between said input and output shafts for selectively drivingly connecting and disconnecting said input and output shafts, said overload clutch means drivingly connecting said input and output shafts upon relatively low load conditions of said output shaft to effect a predetermined drive ratio between said input and output shafts, first and second reduction gear means between said input and output shafts for selectively varying said predetermined drive ratio upon an increase load condition of said output shaft to decrease output shaft speed and increase output shaft torque, said overload clutch means drivingly disconnecting said input and output shafts upon an increase load condition of said output shaft and overrunning clutch means between said first and second reduction gear means for drivingly connecting said first and second reduction gear means upon said overload clutch means drivingly disconnecting said input and output shafts whereby said output shaft is driven through said first and second reduction gear means from said input shaft to thereby decrease output shaft speed and increase output shaft torque, said overrunning clutch means includes first and second overrunning clutch members coupled to the respective first and second reduction gear means, said first overrunning clutch member being in driving relationship to said input shaft through said first reduction gear means, said first and second overrunning clutch members being drivingly connected upon said input shaft speed being greater than said output shaft speed, said overload clutch means includes first and second clutch plates carried respectively by said output shaft and said input shaft, a plurality of clutch elements between said plates, means biasingly urging said plates into cooperative driving engagement through said clutch elements, spring biasing means for engaging the driving connection of said overload clutch means, means for fluidically disengaging said spring biasing means to disengage the driving connection of said overload clutch means, said overload clutch means include first and second clutch plates carried respectively by said output shaft and said input shaft, a plurality of clutch elements between said plates, said spring biasing means being effective for urging said clutch plates into cooperative driving engagement through said clutch elements, and said fluidic disengaging means being effective for urging said clutch plates apart against the force of said spring biasing means.

17. A rotary tool comprising an input shaft and an output shaft, overload clutch means between said input and output shafts for selectively drivingly connecting and disconnecting said input and output shafts, said overload clutch means drivingly connecting said input and output shafts upon relatively low load conditions of said output shaft to effect a predetermined drive ratio between said input and output shafts, first and second reduction gear means between said input and output shafts for selectively varying said predetermined drive ratio upon an increase load condition of said output shaft to decrease output shaft speed and increase output shaft torque, said overload clutch means drivingly disconnecting said input and output shafts upon an increase load condition of said output shaft and overrunning clutch means between said first and second reduction gear means for drivingly connecting said first and second reduction gear means upon said overload clutch means drivingly disconnecting said input and output shafts whereby said output shaft is driven through said first and second reduction gear means from said input shaft to thereby decrease output shaft speed and increase output shaft torque, said overrunning clutch means includes first and second overrunning clutch members coupled to the respective first and second reduction gear means, said first overrunning clutch member being in driving relationship to said input shaft through said first reduction gear means, said first and second overrunning clutch members being drivingly connected upon said input shaft speed being greater than said output shaft speed, said overload clutch means includes first and second clutch plates carried respectively by said output shaft and said input shaft, a plurality of clutch elements between said plates, means biasingly urging said plates into cooperative driving engagement through said clutch elements, means for fluidically disengaging the driving connection of said overload clutch, fluidic motor means for driving said input shaft, and means responsive to a pressure drop caused by resistance to the driving of said fluidic motor means for discontinuing the operation of said fluidic disengaging means whereby said output shaft is driven by said said input shaft through said overload clutch means.

18. A rotary tool comprising an input shaft and an output shaft, overload clutch means between said input and output shafts for selectively drivingly connecting and disconnecting said input and output shafts, said overload clutch means drivingly connecting said input and output shafts upon relatively low load conditions of said output shaft to effect a predetermined drive ratio between said input and output shafts, first and second reduction gear means between said input and output shafts for selectively varying said predetermined drive ratio upon an increase load condition of said output shaft to decrease output shaft speed and increase output shaft torque, said overload clutch means drivingly disconnecting said input and output shafts upon an increase load condition of said output shaft and overrunning clutch means between said first and second reduction gear means for drivingly connecting said first and second reduction gear means upon said overload clutch means drivingly disconnecting said input and output shafts whereby said output shaft is driven through said first and second reduction gear means from said input shaft to thereby decrease output shaft speed and increase output shaft torque, said overrunning clutch means includes first and second overrunning clutch members coupled to the respective first and second reduction gear means, said first overrunning clutch member being in driving relationship to said input shaft through said first reduction gear means, said first and second overrunning clutch members being drivingly connected upon said input shaft speed being greater than said output shaft speed, said overload clutch means includes first and second clutch plates carried respectively by said output shaft and said input shaft, a plurality of clutch elements between said plates, means biasingly urging said plates into cooperative driving engagement through said clutch elements, said first and second reduction gear means are planetary gear sets each including a sun gear and planet gears carried by a cage, and said overrunning clutch means is coupled between the planet cage of one of said first and second reduction gear means and the sun gear of the other of said first and second reduction gear means.

19. The rotary tool as defined in claim 5 wherein said first and second reduction gear means are planetary gear sets each including a sun gear and planet gears carried by a cage, and said overrunning clutch means is coupled between the planet cage of one said first and second reduction gear means and the sun gear of the other of said first and second reduction gear means.

20. The rotary tool as defined in claim 5 wherein said first and second reduction gear means are planetary gear sets each including a sun gear and planet gears carried by a cage, and said overrunning clutch means is coupled between the planet cage of one said first and second reduction gear means and the sun gear of the other of said first and second reduction gear means.

21. The rotary tool as defined in claim 8 including spring biasing means for engaging the driving connection of said overload clutch means, and means for fluidically disengaging said spring biasing means to disengage the driving connection of said overload clutch means.

22. The rotary tool as defined in claim 8 including spring biasing means for engaging the driving connection of said overload clutch means, means for fluidically disengaging said spring biasing means to disengage the driving connection of said overload clutch means, said overload clutch means include first and second clutch plates carried respectively by said output shaft and said input shaft, a plurality of clutch elements between said plates, said spring biasing means being effective for urging said clutch plates into cooperative driving engagement through said clutch elements and said fluidic disengaging means being effective for urging said clutch plates apart against the force of said spring biasing means.

23. The rotary tool as defined in claim 8 including means for fluidically disengaging the driving connection of said overload clutch, fluidic motor means for driving said input shaft, and means responsive to a pressure drop caused by resistance to the driving of said fluidic motor means for discontinuing the operation of said fluidic disengaging means whereby said output shaft is driven by said input shaft through said overload clutch means.

24. The rotary tool as defined in claim 8 wherein said first and second reduction gear means are planetary gear sets each including a sun gear and planet gears carried by a cage, and said overrunning clutch means is coupled between the planet cage of one said first and second reduction gear means and the sun gear of the other of said first and second reduction gear means.

25. The rotary tool as defined in claim 15 wherein said first and second reduction gear means are planetary gear sets each including a sun gear and planet gears carried by a cage, and said overrunning clutch means is coupled between the planet cage of one said first and second reduction gear means and the sun gear of the other of said first and second reduction gear means.

* * * * *